United States Patent [19]

Salamon et al.

[11] 4,146,674

[45] Mar. 27, 1979

[54] FIBRE FILLING OF POLYESTER FIBRES

[75] Inventors: Manfred Salamon; Hans J. Hagebaum; Herbert Pelousek, all of Dormagen; Klaus-Jurgen Schreiber, Marl; Robert Boeck, Dormagen, all of Fed. Rep. of Germany

[73] Assignees: Bayer Aktiengesellschaft, Leverkusen; Faserwerke Hüls Gesellschaft mit beschränkter Haftung, Marl, both of Fed. Rep. of Germany

[21] Appl. No.: 768,574

[22] Filed: Feb. 14, 1977

[30] Foreign Application Priority Data

Feb. 11, 1976 [DE] Fed. Rep. of Germany ..... 2606211

[51] Int. Cl.[2] ..... D02G 3/00

[52] U.S. Cl. ..... 428/361; 428/362; 428/369; 428/375; 428/389; 428/391; 428/395

[58] Field of Search ..... 428/359, 357, 361, 362, 428/364, 369, 375, 378, 391, 395, 413, 370, 371, 389; 252/8.6, 8.8, 8.9

[56] References Cited

U.S. PATENT DOCUMENTS

| | | | |
|---|---|---|---|
| 2,774,691 | 12/1956 | Schroeder et al. | 428/413 X |
| 2,872,428 | 2/1959 | Schroeder | 428/413 X |
| 3,251,794 | 5/1966 | Paliyenko et al. | 260/29.2 |
| 3,271,189 | 9/1966 | Hofmann | 428/359 |
| 3,395,107 | 7/1968 | Burnthall et al. | 428/395 X |
| 3,454,422 | 7/1969 | Mead et al. | 428/361 |
| 3,457,340 | 7/1969 | Arnold | 428/395 |
| 3,488,217 | 1/1970 | Ryan, Jr. | 428/391 |
| 3,639,154 | 2/1972 | Sawa et al. | 428/369 X |
| 3,655,420 | 4/1972 | Tichenor | 428/391 |
| 3,941,856 | 3/1976 | Geoffrey et al. | 428/391 |
| 3,952,134 | 4/1976 | Watson | 428/391 |
| 4,040,371 | 8/1977 | Cooper | 428/362 X |
| 4,053,678 | 10/1977 | Betz et al. | 428/391 |
| 4,062,999 | 12/1977 | Kondo et al. | 428/375 |
| 4,076,869 | 2/1978 | Flynn | 428/413 X |

FOREIGN PATENT DOCUMENTS

| | | | |
|---|---|---|---|
| 933729 | 8/1963 | United Kingdom | 260/29.2 |

*Primary Examiner*—Lorraine T. Kendell
*Attorney, Agent, or Firm*—Plumley and Tyner

[57] ABSTRACT

A fiber filling of polyester fibres with greatly improved serviceability properties comprising a combination of fiber properties, namely denier range, staple length and number of crimp arcs, a specific polysiloxane brightening and an antistatic agent.

3 Claims, No Drawings

FIBRE FILLING OF POLYESTER FIBRES

This invention relates to a fibre filling of polyester fibres, the optimum service properties of which are obtained by a special combination of fibre structure and brightening treatment.

It is known from DT-AS No. 1,444,034 that crimped staple polyester fibres, which have been treated with an aqueous emulsion of a silicone resin, an organometallic silicone-hardening catalyst and an antistatic agent, can be used as filling materials, for example in cushions. Treatment with the above-mentioned aqueous emulsion is said to improve the crimping properties of the fibres. The silicones described in U.S. Pat. No. 2,588,365 and used there for the treatment of textiles are mentioned as particularly suitable silicones. The silicones in question are polydimethyl siloxanes terminally blocked by trimethyl siloxy groups. Water-insoluble polymeric quaternary ammonium carboxylates are mentioned as particularly suitable antistatic agents which, according to DT-AS No. 1,444,034, must also be present in the aqueous emulsion together with the silicones.

In addition, it is known from U.S. Pat. No. 3,271,189 that a fibre filling can be produced from polyester fibres having a thin coating of a methyl polysiloxane cross-linked with a methyl hydrogen polysiloxane.

However, it has been found that a fibre filling produced by conventional methods does not satisfy all the requirements imposed upon its serviceability. In particular, its resistance to washing, i.e. its serviceability after several washes, is not entirely satisfactory. After several washes, a cushion filled with a conventional polyester fibre filling cannot be shaken up to such an extent that it reaches its original filling volume.

Accordingly, an object of the present invention is to provide a fibre filling of polyester fibres which are treated with a silicone brightening, a hardener and an antistatic agent, wherein the filling remains serviceable, even after prolonged use and several washes.

According to the invention, this object is achieved by virtue of the fact that the fibre filling consists of polyester fibres in the denier range of from 3 to 20 dtex with a staple length of from 30 to 70 mm which contain from 22 to 30 crimp arcs per 100 mm of filament length (after drawing) and which are provided with from 0.2 to 2% by weight of a preparation consisting of components (A), (B) and (C)

(A) a mixture of
  (a) polydimethyl siloxane terminally blocked by OH groups and
  (b) polymethyl hydrogen siloxane in a ratio by weight of a:b of about 26:17, (B) a reaction mixture of the epoxide corresponding to the formula:

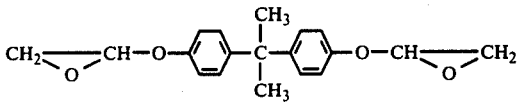

and hexamethylene diamine, (C) a hardener of dioctyl tin maleate and dibutyl tin laurate in a ratio by weight of 1:1, and (D) an antistatic agent.

It is only when the combination of fibre structure and composition of the brightening agent is observed that the fibre filling produced from the polyester fibres has the required favourable service properties.

The fibre filling is obtained by treating a polyester tow which has been drawn, crimped and fixed in known manner and of which the individual filaments have a denier of from 3 to 20 dtex and contain from 22 to 30 crimp arcs per 100 mm of filament length (after drawing), with an aqueous emulsion consisting of (A) a mixture of
  (a) polydimethyl siloxane terminally blocked by OH groups, and
  (b) polymethyl hydrogen siloxane in a ratio by weight of a:b of about 26:17, (B) a reaction mixture of an epoxide corresponding to the formula:

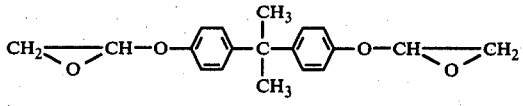

and hexamethylene diamine, (C) a hardener of dioctyl tin maleate and dibutyl tin laurate in a ratio by weight of 1:1, subsequently squeezing the two to a content of emulsion which corresponds to the required solids content, drying and condensing the tow and then applying an aqueous solution of an antistatic agent to form the required effective coating, cutting the tow to a staple length of from 30 to 70 mm and processing the staple fibres obtained in known manner to form a nonwoven structure.

Instead of treating the tow, staple fibres which have already been cut may be treated in the manner described and subsequently processed to form the nonwoven structure.

Suitable polyester fibres are any known fibres of this type obtained in known manner by spinning polyesters obtainable by the polycondensation of dicarboxylic acids and glycols, and correspondingly aftertreating the filaments obtained. Fibres of polyethylene terephthalate, polybutylene terephthalate and the polyester of terephthalic acid and 1,4-cyclohexane dimethanol are particularly suitable.

It is important that the denier of the individual filaments should be in the range of from 3 to 20 dtex, preferably in the range of from 5 to 8 dtex.

The staple length of the polyester fibres is also of considerable importance. It should amount to between 30 and 70 mm and preferably to between 40 and 60 mm.

The number of crimp arcs per 100 mm of filament length (afer drawing) should be between 22 and 30. This parameter has proved to be particularly critical because it determines the behaviour of the fibre filling after washing to a considerable extent. Although fibre fillings of fibres with a high crimp density have a greater initial filling volume than corresponding fibre fillings of fibres with a relatively low crimp density, they do not show the down-like character of fibre fillings of fibres of relatively low crimp density. The fibre fillings are harder, show poorer recovery and, after washing, show a greater tendency to turn lumpy than fibre fillings of fibres of low crimp density.

The mobility of the individual fibres obtained by a low crimp density in the fibre filing which is made up into pillows and quilted articles remains intact above all even after normal domestic washing, so that any shifting of the fibre filling may readily be eliminated by manipulations familiar to the housewife, such as shaking up, smoothing out, etc.

In addition, the low fibre-to-fibre friction of the fibre filling produced by the process according to the invention reduces lumping and "matting" after intensive mechanical stressing.

The composition of the preparation to be applied to the crimped tows is of decisive importance to the service properties of the fibre filling produced from the crimped tows.

The aqueous silicone emulsion contains the two polysiloxane components, polydimethyl siloxane (terminally blocked by OH groups) and polymethyl hydrogen siloxane, in a ratio by weight of about 26:17. The polydimethyl siloxane preferably has a viscosity of from 17000 to 200000 cP, whilst the polymethyl hydrogene siloxane preferably has a viscosity of the order of 15 cP. The best results are obtained with a mixing ratio of 26.1:17.4, although deviations from this ratio of up to ±3% by weight are readily possible without influencing the result to any significant extent. It is extremely important that, in addition, the emulsion should contain the reaction mixture of the diepoxide:

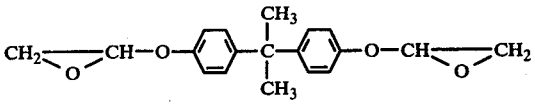

and hexamethylene diamine (hereinafter referred to as "polyepoxide A"). A particularly firmly adhering coating on the fibre material is obtained in this way.

This reaction mixture is obtained, as described in DT-AS No. 1,153,524 by reacting the diepoxide and the diamine with one another in such quantities that there are one to three epoxide groups for every active hydrogen atom of the diamine.

Finally, the silicone oil emulsion contains as hardener a mixture of dioctyl tin maleate and dibutyl tin laurate in a ratio by weight of 1:1 in a quantity of preferably from 1.8 to 18% by weight, based on the polysiloxane components. The silicon emulsion may be applied to the tow by spray coating, splash coating, roll coating and dip coating, dip coating having proved to be particularly effective. The tow is then squeezed to such an extent that, after drying and condensing, an effective coating of from 0.2 to 2%, based on the fibre weight, is present on the tow. The coating preferably amounts to between 0.8 to 1.2%.

It has also been found to be of advantage to apply the antistatic agent in a separate brightening process after the silicone brightening treatment. Before the antistatic agent is applied, the tow is dried and the polysiloxane brightening is condensed thereon. This stage of the process is best carried out over a period of from 2 to 10 minutes at a temperature in the range of from 120° to 180° C.

Suitable antistatic agents are any of the ionic and non-ionic antistatic agents normally used for polyester fibres. They are applied from aqueous solution in an effective coating of generally from 0.1 to 0.6%, preferably from 0.2 to 0.4%, based on the fibre weight. The ethoxylation product of 1,12-dodecane diol is a particularly suitable antistatic agent.

The tow is then cut so that the crimped staple fibres are obtained in a staple length of from 30 to 70 mm, preferably from 40 to 60 mm.

The staple fibres may then be further processed in known manner into nonwoven structures which are eminently suitable for use as fibre fillings for cushions, quilts and the like. This fibre filling is substantially comparable with a natural down filling in regard to its service properties.

The optimum combination of fibre type, denier, staple length and crimp density, the type and quantity of the silicone coating, the quantity of hardener and the type and quantity of antistatic agent, gives a fibre filling with the required properties.

The following examples are to further illustrate the invention without limiting it.

EXAMPLE 1

A crimped and fixed tow of the polyester of terephthalic acid and 1,4-cyclohexane dimethanol with a denier of approximately 50 ktex (individual denier 5.8) and a crimp density of 12 to 14 arcs/50 mm, is brightened with a b 3% by weight aqueous silicone emulsion produced from a parent emulsion of the following compositon:

| | |
|---|---|
| polydimethyl siloxane (terminally blocked by OH groups) | 26.1% by weight |
| polymethyl hydrogen siloxane | 17.4% by weight |
| polyepoxide A | 6.5% by weight |
| HCl | 2.7% by weight |
| water 47.3% by weight | |
| | 100.0% by weight |

and 3 g/l of hardener (based on the 3% solution) consisting of dioctyl tin maleate and dibutyl tin laurate (weight ratio 1:1) by dip coating with a squeezing effect of about 40% and at a throughput rate of about 60 m/minute, dried at 140° to 170° C. and condensed. The effective coating amounts to 1.2% by weight. To the tow is then applied a 7.5% by weight aquoeus solution of the antistatic agent 1,12-dodecane diol (ethoxylated) in an effective coating of 0.3% by weight, and subsequently cut to a staple length of 50 mm. The fibres obtained develop harmless charges of about 50 mm. The volts in conventional installations for the manufacture of nonwovens.

Bulk tests on carded fibre samples show the improved recovery of the material in relation to untreated material (cf. Table 1).

Comparison Example

The procedure was as described in Example 1, except that the crimp density amounted to between 16 and 18 arcs/50 mm. The difference in service properties is shown in Table 1.

EXAMPLE 2

Example 1 was repeated with a fibre having a staple length of 60 mm. The service properties of the fibre filling obtained are shown in Table 1.

To assess filling properties, bulking behaviour and also dimensional and volume stability, the fibre filling described in Examples 1 and 2 and in the Comparison Example was subjected to a bulking and washing test of which the results are shown in Table 1.

| Ex. | Denier dtex | Crimp arcs/ 50 mm | Staple length mm | Bulking behavior E mm | B mm | F mm | Washing behavior after 3 washes in a washing machine at 40° C |
|---|---|---|---|---|---|---|---|
| 1 | 5.8 | 12–14 | 50 | 59 | 31 | 91 | Good; uniform filling |
| 2 | 5.8 | 12–14 | 60 | 57 | 33 | 92 | very good; extremely uniform filling |
| Comparison Ex. | 5.8 | 16–18 | 50 | 46 | 41 | 88 | poor; the fibres agglomerate |

Test Conditions

BULKING TEST:

15 g of carded flocks are introduced into a cylinder with a diameter of 90 mm and a height of 100 mm and dynamically stressed under an applied pressure (stamp) of 25 p/cm$^2$ (100 applications and relaxations 10 mins). F represents the filling level (in mm) on completion of the test, whilst B represents the bulking resistance, i.e. the filling level under the predetermined load of 25 p/cm$^2$, E = F − B represents the elastic recovery.

Washing test:

Cushions measuring 30 × 30 cm and having a fibre filling of 200 g per cushion are washed 3 times at 40° C. in a domestic washing machine and then dried at 80° C. in a recirculating air drying cabinet.

EXAMPLE 3

A drawn, uncrimped and unfixed polyester tow with a denier of 50 ktex (individual denier 5.8 dtex) is brightened by dip coating with a 20% by weight aqueous silicone emulsion obtained from the parent solution described in Example 1 and 1 g of hardener/liter (as in Example 1) of solution, squeezed to approximately 5%, crimped (12 to 14 crimp arcs/50 mm), dried at about 140° to 180° C. and condensed, fixed, brightened by spray coating with the antistatic agent used in Example 1 and cut into staple fibres (staple length 60 mm). Coating of antistatic agent: 0.3% by weight.

The fibre filling obtained behaves in the same way as the fibre filling obtained in accordance with Example 2.

What is claimed is:

1. A fibre filling of crimped polyester fibres, comprising the polyester fibres having a denier of from 3 to 20 dtex, a staple length of from 30 to 70 mm and a crimp arc count of from 22 to 30 per 100 mm and containing from 0.2 to 2% by weight, based on the weight of the fibres, of a preparation comprising the following components (A) to (C):

(A) a mixture of (a) polydimethyl siloxane terminally blocked by OH groups, and (b) polymethyl hydrogen siloxane in a ratio by weight of a:b of about 26:17, (B) a reaction mixture of the epoxide:

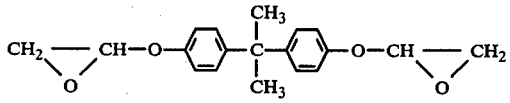

and hexamethylene diamine, and (C) a hardener of dioctyl tin maleate and butyl tin laurate in a ratio by weight of about 1:1, and an antistatic agent.

2. The fibre filling as claimed in claim 1, wherein said polyester fibres contain from 0.1 to 0.6% by weight, based on the weight of the fibres, of ethoxylated 1,12-dodecane diol as the antistatic agent.

3. The fibre filling as claimed in claim 1, wherein said polyester fibres are fibres of a terephthalic acid cyclohexane-1,4-dimethanol polyester.

* * * * *